United States Patent [19]

Meyers et al.

[11] Patent Number: 5,059,307

[45] Date of Patent: Oct. 22, 1991

[54] PROCESS FOR UPGRADING COAL

[75] Inventors: Robert A. Meyers, Tarzana; Walter D. Hart, Upland; Leslie J. Van Nice, deceased, late of, Manhattan Beach, all of Calif., by Norma R. Van Nice, executor; Leslie J. Van Nice, heir, Coos Bay, Oreg.

[73] Assignees: TRW Inc., Redondo Beach, Calif.;

[21] Appl. No.: 419,659

[22] Filed: Oct. 11, 1989

Related U.S. Application Data

[63] Continuation of Ser. No. 770,324, Aug. 27, 1985, abandoned, which is a continuation-in-part of Ser. No. 486,976, Mar. 10, 1983, Pat. No. 4,545,891, which is a continuation-in-part of Ser. No. 349,514, Mar. 31, 1981, Pat. No. 4,445,756.

[51] Int. Cl.[5] ..... C10G 1/00

[52] U.S. Cl. ..... 208/404; 208/406; 208/405; 208/428; 208/429; 44/608; 44/620; 44/621; 44/622; 44/624; 44/627; 423/DIG. 12; 201/17

[58] Field of Search ..... 44/621, 622, 627, 624, 44/608, 620; 208/404, 405; 423/DIG. 12; 201/17

[56] References Cited

U.S. PATENT DOCUMENTS

| | | | |
|---|---|---|---|
| 506,051 | 10/1893 | Langville . | |
| 1,703,192 | 2/1929 | Hampton | 208/11 R |
| 1,938,672 | 12/1933 | Ruthruff | 196/26 |
| 2,034,818 | 3/1936 | Loughrey | 196/24 |
| 2,162,221 | 6/1939 | Kasehagen et al. | 44/1 |
| 2,316,005 | 4/1943 | Lachle | 260/428 |
| 2,609,331 | 9/1952 | Cheney | 202/11 |
| 2,694,035 | 11/1954 | Smith et al. | 196/49 |
| 2,768,935 | 10/1956 | Watkins | 196/52 |
| 2,878,163 | 8/1956 | Hutchings . | |
| 2,902,430 | 9/1959 | Kimberlin, Jr. et al. | 208/90 |
| 2,940,919 | 6/1960 | Hemminger | 208/11 |
| 2,950,245 | 8/1960 | Thomsen | 208/348 |
| 2,957,818 | 10/1960 | Fischer | 208/11 |
| 2,980,600 | 4/1961 | Kelley | 208/11 |
| 3,075,913 | 1/1963 | Scheffel et al. | 208/11 |
| 3,108,059 | 10/1963 | Greenwald | 208/11 |
| 3,166,483 | 1/1965 | Masciantonio | 202/25 |
| 3,166,483 | 11/1965 | Masciantonio | 201/17 |
| 3,296,117 | 1/1967 | Ross et al. | 208/11 |
| 3,393,978 | 7/1968 | Murphy et al. . | |
| 3,407,003 | 10/1968 | Durie | 299/4 |
| 3,501,201 | 3/1970 | Closmann et al. | 299/4 |
| 3,510,168 | 5/1970 | Camp | 299/5 |
| 3,522,168 | 7/1970 | Bichard et al. | 208/11 |
| 3,542,666 | 11/1970 | Simpson | 208/11 |
| 3,556,982 | 1/1971 | Kaminsky et al. | 208/11 |
| 3,572,838 | 3/1971 | Templeton | 299/4 |
| 3,644,194 | 2/1972 | Keely et al. | 208/11 |
| 3,708,270 | 1/1973 | Birk et al. | 48/202 |
| 3,739,851 | 6/1973 | Beard | 166/254 |
| 3,753,594 | 8/1973 | Beard | 299/4 |
| 3,759,328 | 9/1973 | Ueber et al. | 166/303 |
| 3,759,574 | 9/1973 | Beard | 299/4 |
| 3,779,601 | 12/1973 | Beard | 299/4 |
| 3,779,722 | 12/1973 | Tatum . | |

(List continued on next page.)

OTHER PUBLICATIONS

Coal Desulfurization, R. A. Meyers, 1977, pp. 25–54, 201–209, 230–4.

"Conversion of coal to simple compounds", Parker et al. Industrial & Engr. Chem., vol. 47, No. 6, Aug., 1955, pp. 1586–1592.

The effect of molten caustic on Pyritic Sulphur in Bituminous Coal, Masciantonio, pp. 269–275.

Masciantonio, "The Effect of Molten Caustic on Pyritic Sulphur in Bituminous Coal", Applied Research Laboratory United States Steel Corp. (1904).

*Primary Examiner*—Helane E. Myers

*Attorney, Agent, or Firm*—Michael B. Farber; Sol L. Goldstein; Jeffrey G. Sheldon

[57] ABSTRACT

In a process for reducing the sulfur and ash contents of coal, coal is sequentially contacted with fused alkali metal caustic, water, carbonic acid, and a strong acid. Caustic removed from the coal by the water and the carbonic acid is recovered as anhydrous caustic for again contacting coal.

32 Claims, 2 Drawing Sheets

U.S. PATENT DOCUMENTS

| | | | |
|---|---|---|---|
| 3,788,978 | 1/1974 | Bearden, Jr. jet al. | 208/208 M |
| 3,846,276 | 11/1974 | Walker | 208/11 |
| 3,909,213 | 9/1975 | Sanders | 44/1 R |
| 3,919,118 | 11/1975 | Robinson et al. | 423/461 |
| 3,934,935 | 1/1976 | Lambly et al. | 299/2 |
| 3,951,457 | 4/1976 | Redford | 299/5 |
| 3,960,513 | 6/1976 | Agarwal et al. | 44/1 R |
| 3,966,582 | 6/1976 | Cramer | 208/8 |
| 3,967,853 | 7/1976 | Closmann et al. | 299/4 |
| 3,970,434 | 7/1976 | Gasior et al. | 44/1 F |
| 3,993,455 | 11/1976 | Reggel et al. | |
| 4,003,823 | 1/1977 | Baird, Jr. et al. | 208/108 |
| 4,026,359 | 5/1977 | Closmann | 166/263 |
| 4,032,193 | 6/1977 | Drinkard et al. | 299/4 |
| 4,055,400 | 10/1977 | Stambaugh et al. | 44/1 SR |
| 4,087,514 | 5/1978 | Robinson et al. | 423/461 |
| 4,092,236 | 5/1978 | Heredy | 208/10 |
| 4,108,760 | 8/1978 | Williams et al. | 208/11 |
| 4,118,200 | 10/1978 | Kruesi | 44/1 R |
| 4,120,776 | 10/1978 | Miller et al. | 208/11 |
| 4,130,474 | 12/1978 | Anthony | 208/11 |
| 4,132,448 | 1/1979 | Davis | 299/5 |
| 4,134,737 | 1/1979 | Yang | 44/1 R |
| 4,152,120 | 5/1979 | Zavitsanos et al. | 44/1 F |
| 4,158,638 | 6/1979 | Tsai | 208/11 |
| 4,167,397 | 9/1979 | Grant | 44/1 R |
| 4,168,148 | 9/1979 | Anthony et al. | 44/1 SR |
| 4,174,953 | 11/1979 | Sun et al. | 44/1 R |
| 4,188,191 | 2/1980 | Longanbach et al. | 44/1 R |
| 4,191,425 | 3/1980 | Davis | 299/5 |
| 4,213,765 | 7/1980 | Wilson | 44/15 R |
| 4,226,601 | 10/1980 | Smith | 44/10 D |
| 4,260,471 | 4/1981 | Miller | 44/1 SR |

PROCESS FOR UPGRADING COAL

RELATED APPLICATIONS

This application is a continuation of application Ser. No. 770,324, filed Aug. 27, 1985, now abandoned, which is a continuation-in-part of U.S. Patent Application Ser. No. 486,276 filed on Mar. 10, 1983 by Robert Meyers and Walter D. Hart, now U.S. Pat. No. 4,545,891 issued on Oct. 8, 1985; which is based on an International Application filed under the Patent Cooperation Treaty, application No. PCT/US82/00394 filed on Mar. 30, 1982, published on Oct. 14, 1982, Publication No. WO82/03404; which is based, as a continuation-in-part, on U.S. Application Ser. No. 349,514 filed on Mar. 31, 1981 now U.S. Pat. No. 4,445,756. These applications are incorporated herein by this 1 reference.

BACKGROUND

This invention is directed to a process for reducing the sulfur and ash contents of coal.

The United States, with nearly one-half trillion metric tons of coal reserves, has the largest total coal reserves in the world. Increased coal utilization in this country has been hampered by environmental constraints, such as restrictions on sulfur dioxide, nitrogen oxides, and particulate emissions. There is a need for new technology to meet these environmental constraints at costs acceptable to coal users.

Molten caustic can be used to leach ash and sulfur from coals as described in aforementioned U.S. Pat. Application Ser. No. 486,276 filed on Mar. 10, 1983 now U.S. Pat. No. 4,545,891 by Robert Meyers et al. However, until now there has been no known method for recycling substantially all of the caustic used in the process. Cost and environmental considerations require reuse, rather than disposal, of the used caustic. Therefore, there is a need for a process using molten caustic that effectively removes sulfur and mineral matter from coal, and that also enables the caustic and acid cleaning solutions to be recovered for reuse in the process.

SUMMARY

This invention provides a process that satisfies this need. Mine-cleaned coal can be processed to yield a product coal with less than about 0.1% ash and less than about 0.5% sulfur. Also, most of the caustic used in the process is recovered and recycled for reuse. This is important for both economic and environmental reasons.

In general, this is achieved by sequentially treating the coal with fused alkali metal caustic, water, carbonic acid, and a strong acid, with attendant steps for recovering the caustic.

More specifically, feed coal, which preferably has been physically cleaned to less than about 10% ash by weight and less than about 4% sulfur by weight, is treated in a coal caustic reaction zone with fused alkali-metal caustic at an elevated temperature of from about 280° to about 400° C., preferably from about 325° to about 390° C., more preferably at about 370° C. This yields spent caustic and caustic-treated coal. Mineral matter and sulfur are removed from the coal by the caustic, and are contained in the spent fused caustic. The removed sulfur exists mostly as alkali metal sulfides. The caustic reacts with the feed coal to form bound alkali, which is chemically bound on the treated coal. The amount of bound alkali is typically about 3% by weight of the coal.

Any portion of the spent fused caustic, which can be filtered or drained from the coal, can be recycled for reuse in the reaction zone. A mixture of the caustic-treated coal and the remainder of the spent fused caustic, in an amount from about 2 to about 5 parts by weight spent fused caustic per part by weight of coal, is then washed with water in a water wash zone to give a water-washed coal and a caustic-rich water.

The water-washed coal has a free caustic content of no more than about 5% by weight, preferably less than about 1% by weight of the coal. It also contains about 1 to about 3% by weight alkali that is ionically bonded to the coal. The water-washed coal is washed with aqueous carbonic acid in a carbonic acid wash zone to give a carbonic acid-washed coal and a first alkali metal carbonate solution. The carbonic acid wash can be effected by bubbling carbon dioxide into an aqueous slurry of the water-washed coal.

The carbonic acid-washed coal has substantially reduced caustic. It contains no more than about 1.5%, preferably less than about 1%, and more preferably less than about 0.5% by weight bound alkali and substantially no free caustic. The bound alkali content of the coal can be lower than about 0.2% by weight. The carbonic acid-washed coal is then washed with an acid stronger than carbonic acid in a strong acid wash zone to give a product coal and a spent acid. The strong acid preferably has a pH of less than about 2. The strong acid preferably is sulfuric acid.

The product coal contains substantially no bound alkali. It contains less than about 0.1% ash, and less than about 0.5% sulfur. The product coal can optionally be washed with water to remove any acid left. It can then be dried, or slurried with water for transportation or use as fuel.

The caustic-rich water from the water wash zone contains about 40 to 60% by weight aqueous caustic. It also contains mineral matter and sulfur contained in the spent fused caustic entering the water wash zone. The caustic-rich water is cooled in a cooling zone to yield a concentrated aqueous caustic and a first precipitate comprising alkali metal sulfides and mineral matter. The first precipitate is separated from the concentrated aqueous caustic, and is then contacted with water to give (i) an alkali metal sulfide solution and (ii) solid mineral matter which is then separated and disposed.

The alkali metal sulfide solution is treated with carbon dioxide in a sulfide reaction zone to generate hydrogen sulfide gas and a second alkali metal carbonate solution comprising alkali metal carbonates and bicarbonates. The hydrogen sulfide can be further processed to form sulfuric acid for use in the strong acid wash zone.

The first alkali metal carbonate solution from the carbonic acid wash system and the second alkali metal carbonate solution from the sulfide reaction zone are treated with lime in a caustic regeneration zone, thereby producing a dilute aqueous caustic and a second precipitate containing calcium carbonate. The second precipitate is separated and is then heated in a lime recovery zone to regenerate lime for reuse. Carbon dioxide is generated in the lime recovery zone, and can be used in the carbonic acid wash zone and for treating the alkali metal sulfide solution.

The concentrated aqueous caustic from the cooling zone and the dilute aqueous caustic from the caustic regeneration zone are sent to a water removal zone, where a clean dry caustic is produced for recycle to the coal/caustic reaction zone. The water removed can be used to satisfy water needs in the process.

If sulfuric acid is used in the strong acid wash zone, the spent acid can be neutralized with lime before disposal. Alternatively, the spent acid can be electrolyzed to produce dilute caustic and sulfuric acid.

Because of the sequential caustic treatment, water wash, carbonic acid wash, and mineral acid wash, coal of low sulfur and ash content can be produced. Moreover, because of the carbonic acid wash step, the caustic can easily and economically be recovered for reuse.

DRAWINGS

These and other features, aspects, and advantages of the present invention will become better understood with reference to the following description, appended claims, and accompanying drawings, where:

DESCRIPTION

Figure 1:
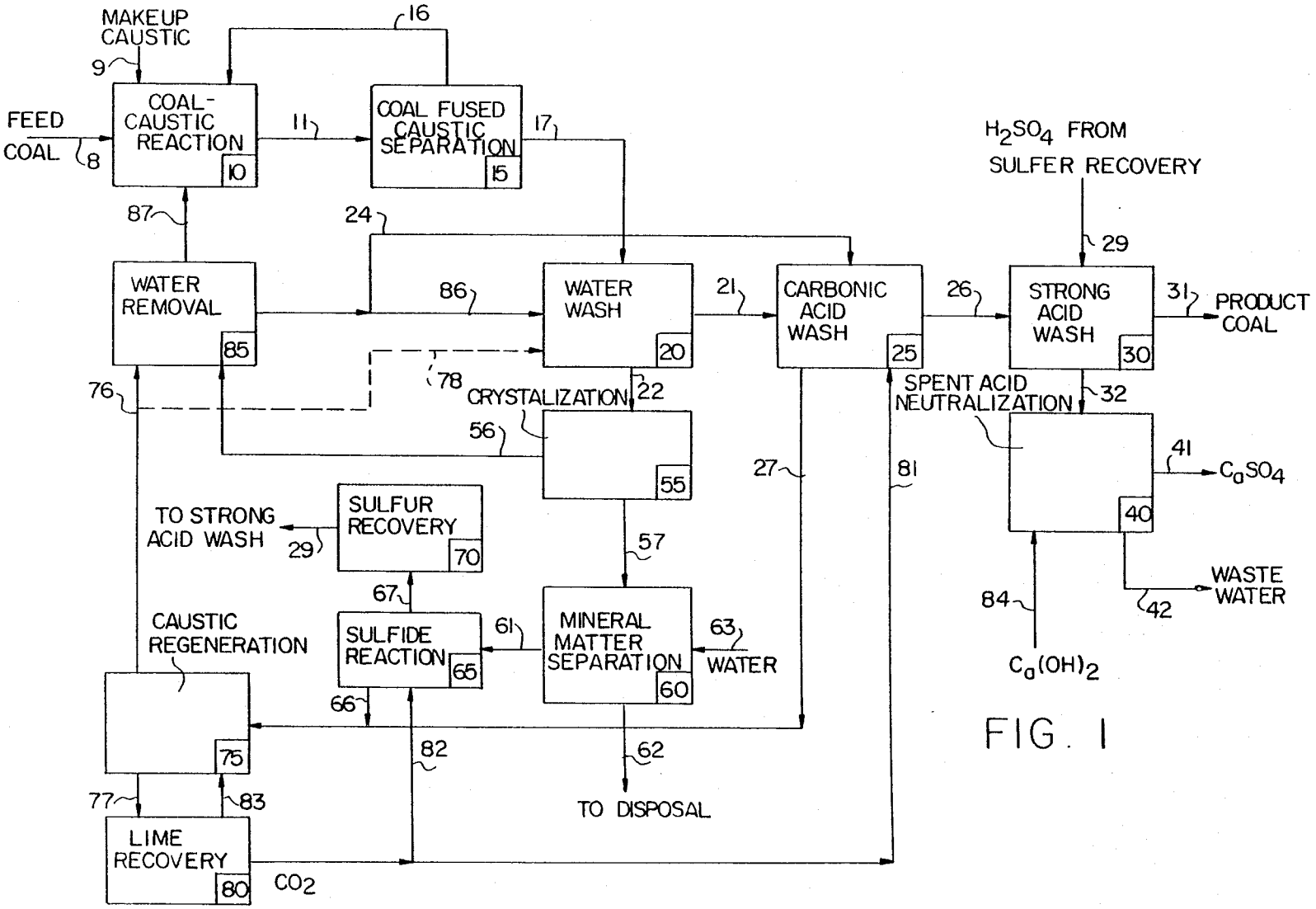
FIG. 1 is a process flow chart of a preferred version of the process of this invention.

A process according to the present invention is shown in FIG. 1, and generally comprises (1) coal upgrading, (2) mineral matter and sulfur disposal, (3) caustic recovery, and (4) spent acid disposal.

Coal Upgrading

Feed coal 8 is fed to a coal-caustic reaction zone 10. Preferably the feed coal 8 is upgraded before entering the coal-caustic reaction zone. For example, the coal can be crushed and sized to a dimension of less than about ⅜ inch. Preferably the feed coal 8 is physically cleaned by well known methods such as water washing, flotation separation, etc., to about 10% ash and from about 2 to about 4% sulfur. Although high ash and/or high sulfur content coal can be crushed and used directly in the process of FIG. 1, the process is more efficient with cleaned coal. The sulfur in the coal is usually in the form of pyritic and organic sulfur. The ash-forming mineral matter in the coal usually comprises clays, shales, and pyrite, but also comprises lesser amounts of minerals containing substantially every chemical element known.

The feed coal 8 is combined with make-up alkali metal caustic 9 in the coal-caustic reaction zone 10. Caustic materials suitable for this invention include alkali metal caustics. The alkali metal can be selected from Group IA metals of the periodic table, with the hydroxides of sodium and potassium being the preferred alkali metal caustic since they can easily be regenerated. Sodium hydroxide is usually used because of its low cost and availability. Alternatively a mixture of sodium hydroxide and potassium hydroxide can be used.

The coal-caustic reaction zone 10 is maintained at an elevated temperature at which the caustic material is in a fused or molten state. When the coal contacts molten caustic, sulfur and mineral matter are removed from the coal and become dissolved or suspended in the caustic. The sulfur dissolves in the caustic mainly an alkali-metal sulfides. The ash-forming mineral matter dissolves in the form of aliminates, silicates, ferrites, and the like.

It was discovered that the alkali-metal caustic also reacts with the coal to form bound alkali. The exact mechanism is not known, but it is postulated that the caustic reacts with acidic functional groups on the coal matrix to give alkali metal salts. Thus the alkali metal groups are bound chemically by means of ionic bonding on the coal matrix, giving bound alkali. Typically the amount of bound alkali is about 3% by weight of the coal. The chemically "bound alkali" is distinguished from "non-bound" or "free alkali" in that "free alkali" can be removed from the coal with a few water extractions.

The temperature in the coal-caustic reaction zone 10 is important. Preferably the temperature is from about 280° to about 400° C. At temperatures less than about 280° C., the extraction of ash and sulfur is slow and incomplete. At temperatures higher than about 400° C., the coal loses a substantial amount of its volatiles in coking reactions. The preferred temperature is from about 325° to about 390° C.

Reactor pressure does not appear to have a significant effect on the coal-caustic reaction. Therefore the reaction can be carried out at atmospheric pressure. A small positive pressure can be maintained in the coal-caustic reaction zone 10 to help the reactants flow downstream. A small positive pressure also works to keep air out of the reaction zone 10. The reaction can take place in an inert atmosphere such as under a nitrogen blanket.

The residence time in the coal-caustic reaction zone 10 can be as short as 5 minutes and still give some sulfur and mineral matter extraction. Typically the reactor residence time is from about 1 hour to about 4 hours. However, when a microwave heat source is used, the residence time can be reduced to within the range of from about 1 to about 5 minutes.

Preferably the mass ratio of caustic to coal is from about 2 to about 20 parts caustic per part of coal. In some applications, the amount of alkali metal caustic fed to the coal-caustic reaction zone 10 needs to be sufficient to form a free flowing slurry with the coal. For those applications, a caustic/coal ratio of at least about 4:1 is used because at lower ratios, the coal-caustic mixture is no longer fluid. At ratios less than about 4:1, the mixture in the reaction zone 10 is "putty-like". Preferably the caustic to coal mass ratio is less than about 20:1 for an economical process and to have a small reactor size. The smaller the ratio, the smaller the reactor size. A typical caustic/coal ratio used in reactor 10 is no more than about 10:1.

Reactors of various designs can be used in the coal-caustic reaction zone 10. There can be a single reactor, or multiple reactors set up in stages. The flow of caustic and coal can be cocurrent or countercurrent. Because coal is less dense than the molten caustic, the coal tends to float to the top of the reaction mixture. It is thus necessary to have good mixing in reaction zone 10 to ensure efficient and sufficient contact between the coal and the fused caustic.

An effluent mixture 11 comprising spent fused caustic and caustic treated coal exits the coal-caustic reaction zone 10. The spent fused caustic contains impurities such as sulfides, carbonates, and mineral matter in solution or in a suspended form. The caustic treated coal has reduced sulfur and mineral matter contents compared to the feed coal 8, but contains bound alkali.

When the caustic to coal mass ratio is greater than about 4:1, the mixture 11 is separated in a coal-fused caustic separation zone 15 to give a coal-lean spent fused caustic 16, and a coal-rich spent fused caustic 17. Preferably the coal-lean spent fused caustic 16 contains less than 10% by weight coal.

The coal-fused caustic separation zone 15 can involve well known methods for solids/liquid separation. For example, the separation zone 15 can have a pressure or vacuum filter. Alternatively, the separation zone 15 can comprise a quiet zone and a separator. In the quiet zone, the effluent mixture 11 is left relatively undisturbed and the coal floats to the surface of the molten spent caustic due to the difference in densities between the coal and the caustic (the specific gravity of coal is about 1.2–1.3 and the specific gravity of caustic is about 1.8 at reaction temperatures). In the separator the coal on top is skimmed or decanted off. To effectuate solid/liquid separation, it is necessary to maintain the separation zone 15 at a temperature above the melting point of the caustic material used.

If separated from the coal, the coal-lean spent fused caustic 16 is returned to the coal caustic reactor system 10 for reuse. Although the maximum solubilities of sulfur and mineral matter in fused caustic are in the ranges of from about 4 to about 5% and from about 10 to about 15%, respectively, it is desirable to maintain the sulfur concentration in the recycled spent fused caustic 16 at from about 1 to about 2%, and mineral matter concentration at from about 3 to about 5%. Higher sulfur and/or mineral matter concentrations in the recycled spent fused caustic 16 adversely affect the extraction efficiencies in the coal-caustic reaction zone 10.

The coal-rich spent fused caustic stream 17 exiting the separation zone 15 comprises caustic-treated coal containing bound alkali, typically mixed with from about 2 to about 5 parts by weight spent fused caustic per part of coal. A small ratio of spent fused caustic/-coal is preferred. As will be explained later, a substantial portion of the caustic material in this stream is stripped of impurities and regenerated to produce clean caustic for reuse in the coal-caustic reactor 10. By controlling the amount of spent fused caustic in the coal-rich stream 17, it is possible to control the equilibrium concentration of ash and sulfur in the caustic in reaction zone 10.

The mixture of caustic treated-coal and spent fused caustic in the coal-rich stream 17 is then contacted with water in a water wash zone 20. This separates the spent fused caustic from the caustic-treated coal, producing water-washed coal 21 and effluent caustic-rich water 22. As will be discussed later, the water added in the water wash zone 20 is removed in order to generate clean dry caustic for reuse in coal-caustic reaction zone 10. Water removal consumes energy. Therefore it is preferable that a minimum amount of wash water be used. The amount of water used is preferably from about 1 to about 2 parts by weight water per part caustic to be washed off the coal. The caustic-rich water 22 can contain about 40 to about 60% by weight alkali metal caustic.

To minimize water use, preferably a countercurrent staged water wash system is used. In each stage, coal is slurried with water, and the slurry is separated into wet coal and a liquid, the coal being sent to the following stage and the liquid to the prior stage. The final wash stage can use essentially pure water, such as a condensate 86 from a water removal zone 85 (described below). Optionally dilute aqueous caustic generated in other parts of the process, such as stream 78 from a caustic regeneration zone 75, can be added to the wash water in any wash stage but the final stage. Stream 77 contains 5 to 10% aqueous caustic and is destined for the water removal zone 85, as will be explained later. Bypassing the water removal step saves energy.

Because of the high temperature of the coal-rich stream 17, the caustic-rich water in the first wash stage is usually boiling. Fifty percent caustic boils at about 140° C. The aqueous caustic can be cooled before separating the coal from the water. Pressure does not appear to affect the water wash performance. To obviate the need for costly pressurized equipment, preferably the water wash is conducted at atmospheric pressure.

The effluent caustic-rich water 22 contains alkali metal sulfides that were present in the spent fused caustic/coal mixture. The alkali metal sulfides have a solubility of 1% or more in fifty percent aqueous caustic at elevated temperatures. The effluent caustic-rich water 22 also contains the mineral matter that was present in the spent fused caustic. This mineral matter is insoluble in this aqueous caustic. It can be separated from coal because of the difference in density between the mineral matter and the sodium containing coal; coal has a specific gravity of from about 1.2 to about 1.3, and the mineral matter has a specific gravity of about 2 or more.

The water-washed coal 21 preferably has a free caustic content of no more than about 5% by weight. More preferably, the free caustic content is less than about 1% by weight of the coal. The water-washed coal also contains chemically bound alkali present in the caustic-treated coal. Water washing does not remove the chemically bound alkali metal species unless an economically infeasible number of water washes are used.

The water-washed coal 21 is passed to a carbonic acid wash zone 25 where the coal is contacted with carbonic acid to form carbonic acid-washed coal 26 and a first carbonate solution 27. This can be effected by bubbling carbon dioxide 81 into an aqueous slurry of the coal 21 and water 24. Alternatively, the carbon dioxide can be dissolved in the water before the slurry is formed. Bubbling is preferred as it provides agitation and promotes efficient solid/liquid contact. The water 24 used can comprise condensate wash water from the water removal zone 85. The source of carbon dioxide can be a carbon dioxide effluent stream 81 from a lime recovery zone 80 (described below) which decomposes limestone by heat. The amount of water 24 used is preferably from about 2 to about 10 parts by weight water per part coal, so as to form a free flowing slurry with coal.

The efficiency of acid removal of bound alkali from the coal 21 is pH dependent. The removal is more complete at lower pH's. Preferably the mixture in the carbonic acid wash zone 25 is maintained at a pH of no more than about 6, and preferably no more than about 5. Water saturated with carbon dioxide at room temperature has a pH of about 4. After mixing the saturated aqueous carbonic acid with the water-washed coal in a mass ratio of from about 5 to about 10:1, the pH of the mixture in the carbonic acid wash zone 25 is usually from about 4 to about 6. The carbonic acid neutralizes the free caustic. The hydrogen ions in this moderately acidic mixture also displace a substantial portion of the bound alkali on the coal, and release the alkali metal species into solution. The first carbonate solution therefore contains carbonates of the alkali metal species. At a pH of between 4 and 6, both carbonates and bicarbonates are present.

Carbonic acid wash can be effected at room temperature and pressure. The residence time of the coal in the carbonic acid wash zone 25 is at least 10 minutes and can be as much as 20 minutes to insure that the bulk of the bound alkali on the coal is removed.

Bound alkali removal from the coal can range from about 60 to about 80% if the carbonic acid wash system 25 has only one stage. Greater than 90% removal of bound alkali from the coal can be achieved by adding stages. The carbonic acid-washed coal 26 preferably contains no more than about 1.5% by weight bound alkali, more preferably less than about 1%, and most preferably less than about 0.5% by weight bound alkali. The bound alkali content can be lower than 0.2%.

The carbonic acid wash can be effected in one stage or in multiple stages, either cocurrently or countercurrently.

After the required residence time has elapsed, the mixture in the carbonic acid wash zone 25 is separated by well known solid/liquid separation methods such as filtering to give (i) the first carbonate solution 27 containing the carbonates and bicarbonates of the alkali metals of the caustic and (ii) the carbonic acid-washed coal 26. The carbonic acid-washed coal 26 contains substantially no free caustic.

As discussed in the examples, there are limits to the completeness of bound alkali removal when carbonic acid is used. An acid stronger than carbonic acid (lower pH) is used to complete the bound alkali removal process in a strong acid wash system 30. The carbonic acid-washed coal is contacted with a strong acid with a pH of preferably less than about 2 in the strong acid wash system 30. Mineral acids such as sulfuric, sulfurous, nitric or hydrochloric acid can be used. Preferably a dilute sulfuric acid 29 with a pH of from about 1 to about 2 is used. Sulfuric acid 29 can be generated in a sulfur recovery zone 70, using the sulfur removed from the feed coal. This process generated sulfuric acid is preferred because of its low cost. The amount of acid used preferably is from about 5 to about 10 parts by weight dilute acid per part by weight coal, in order to form a free flowing slurry.

The coal is separated from the strong acid by solid/-liquid separation methods, such as filtering, to give a product coal 31 and a spent acid 32. The product coal 31 preferably has an ash content (mineral matter plus bound alkali) of less than about 0.1% by weight, and preferably contains less than about 0.5% by weight sulfur.

The product coal 31 can optionally be washed with sufficient water to remove any strong acid adhering to the coal. It can then be dried, or slurried with water, for transportation or use as a fuel.

Mineral Matter and Sulfur Disposal

The caustic-rich water 22, containing from about 40 to about 60% by weight alkali metal caustic, and also containing insoluble mineral matter, enters a cooling zone such as crystallization zone 55. The temperature of the caustic-rich water 22 is about the boiling point of the aqueous caustic, which is about 140° C. for 50% aqueous caustic. The alkali-metal sulfides dissolved in the coal-rich spent fused caustic stream 17 are soluble in an amount of 1 percent or more in 50% aqueous caustic at elevated temperatures. Therefore, the alkali metal sulfides are totally or mostly in solution. The solubility of alkali-metal sulfides decreases to about 0.1% in 50% aqueous caustic at room temperature. The crystallization zone 55 is operated at substantially room temperature. As the caustic-rich water 22 cools, the dissolved alkali metal sulfides precipitate.

The solids and liquid in the crystallization zone 55 are then separated by well known separation methods such as filtering, to give a low sulfur concentrated aqueous caustic 56, and a mixture 57 of sulfides and mineral matter.

The sulfides and mineral matter mixture 57 are passed to a mineral matter separation zone 60, where water 63 is added. The water 63 can comprise condensate from the water removal zone 85. The water 63 dissolves substantially all of the alkali metal compounds present, including the sulfides and other soluble compounds, to form a concentrated aqueous caustic 61. The insoluble mineral matter 62 is separated by methods such as filtering, and is then disposed. Since the mineral matter 62 is insoluble in water, it is useful for landfill.

The concentrated aqueous caustic 61, containing dissolved alkali metal sulfides and other soluble compounds, then enters a sulfide reaction zone 65, to which carbon dioxide 82 is added. The carbon dioxide 82 can be produced in the lime recovery zone 80 by thermal decomposition of limestone. The carbon dioxide reacts with the alkali-metal sulfides to give hydrogen sulfide gas 67 and a second carbonate solution 66 containing alkali metal carbonates and bicarbonates.

The hydrogen sulfide gas 67 passes to a sulfur recovery zone 70, where the sulfur is recovered as elemental sulfur, or further converted to sulfuric acid 29, by well known processes such as by burning the hydrogen sulfide in the presence of air. For example, the sulfur recovery zone 70 can include a Claus unit. The sulfuric acid 29 thus generated can be used in the strong acid wash zone 30 as described previously.

Caustic Recovery

The first carbonate solution 27 from the carbonic acid wash system 25, and the second carbonate solution 66 from the sulfide reaction zone 65, both containing alkali metal carbonates and bicarbonates, enter a caustic regeneration zone 75 for regenerating the caustic used in the coal-caustic reaction zone 10. For best performance the concentration of the carbonate and bicarbonate species preferably are in the range of from about 10 to about 15% by weight carbonate. The liming reaction described below works best with these concentrations. Water can be added for dilution if necessary.

Slaked lime or quick lime 83, produced by thermal decomposition of limestone in the lime recovery zone 80, enters the caustic regeneration zone 75. The lime 83 increases the pH of the mixture in reactor system 75 above about 12, thereby converting substantially all the bicarbonate into carbonates. Calcium carbonate 77 is precipitated and is removed by well known solid/liquid separation methods such as filtering, and is returned to the lime recovery zone 80. The carbon dioxide produced in the lime recovery zone 80 can be used in the carbonic acid wash zone 25 and the sulfide reaction zone 65, as described above.

The remaining solution in the caustic regeneration reactor system 75 is a dilute aqueous caustic 76. It comprises aqueous caustic (alkali metal hydroxides) with a concentration in the range of from about 5 to about 10% by weight caustic. The bulk of the dilute aqueous caustic 76 is passed to a water removal zone 85. A portion 78 can be used as wash water in the intermediate wash stages of the water wash zone 20.

The low sulfur concentrated aqueous caustic 56 from the crystallization zone 55, containing from about 40 to about 60% aqueous caustic, is also passed to the water removal zone 85. Evaporators can be used in the water removal zone 85. As described above, the condensate from the evaporator can be fed to the water wash zone 20 and the carbonic acid wash zone 25.

A clean anhydrous alkali metal caustic exits water removal zone 85, and is returned to coal caustic reaction zone 10 for reuse.

Spent Acid Disposal

If the acid used in strong acid wash zone 80 is sulfuric acid, the following steps can be taken to treat the spent acid 32. The spent acid 32 contains a small amount of alkali metal sulfates and dilute sulfuric acid. It can be neutralized with lime in a spent acid neutralization zone 40 to precipitate calcium sulfate. The calcium sulfate can be separated and discharged as stream 41 for disposal by methods such as landfill. The waste water 42 contains a small amount of alkali-metal sulfates, and can safely be discharged. Alternatively, the spent sulfuric acid can be electrolyzed to produce dilute caustic and regenerated sulfuric acid.

Advantages of the Process

The present invention has important advantages over prior art methods using fused caustic to treat coal for removal of sulfur and mineral matter. Previously there has not been an economical method for recycling most of the caustic used. Recycling of caustic is important for both economic and environmental reasons. Make-up caustic can be expensive. Disposal of waste caustic material can also be costly and difficult from an environmental protection standpoint. The process of this invention allows recycle to be effected economically.

As described previously, it was discovered that in coal-caustic reaction zone 10 the fused caustic reacts with acidic groups of the coal matrix to form bound alkali, which is ionically bound to the coal. The removal of mineral matter from the coal thus involves more than a single step of dissolution of the original mineral matter in the fused caustic, as the caustic treated coal now contains bound alkali. This bound alkali cannot be removed by an economical number of water washes. If the coal is not further treated beyond the water wash step, the bound alkali will show up as ash upon combustion of the coal. Furthermore, this loss of caustic material as bound alkali is significant. The amount of bound alkali can be about 3% by weight. That amounts to about 60 pounds sodium, which is about 100 pounds of sodium hydroxide per short ton of coal, if the alkali metal is sodium based. This quantity of lost caustic would have to be replenished. The make-up cost could render the coal upgrading process uneconomical.

It was discovered that bound alkali removal can be effected with carbonic acid. In view of the necessity for caustic recovery, carbonic acid must be used to the exclusion of organic acids and strong acids such as sulfuric, sulfurous nitric and hydrochloric acids. All other acids are unsatisfactory because regeneration of a clean caustic is difficult and expensive when such acids are used. Further, organic acids and strong mineral acids are more expensive to use than is carbonic acid which can be prepared from process generated carbon dioxide.

The effective recycling of caustic reduces pollution problems. For example, if only sulfuric acid is used, the solid calcium sulfate in stream 41 for disposal would contain soluble alkali metal compounds, which could leach from the solids sulfate after disposal. But if a carbonic acid wash step is added, most of the bound alkali is removed from the water washed coal in carbonic acid wash zone 25. The spent acid stream 32 contains very little soluble alkali species. In turn, the calcium sulfate stream 41 also contains less alkali metal compounds than without the carbonic acid wash step, and the leaching problem is abated. Therefore it is important to remove as much of the bound alkali as possible at the carbonic acid wash step.

The process of this invention produces either a crushed coal product or a coal water mixture suitable for pumping. The process is especially attractive because the product coal can be used both to replace oil in boilers, turbines and diesel engines, and as an alternative to flue gas desulfurization for coal fired utilities and industrial boilers. The process serves as a strategic response to potential interruptions in imported oil supplies, and provides for the inevitable shortfall in oil production as world oil reserves begin to run out toward the end of the 20th century.

Moreover, all of the steps of the process can be conducted at substantially atmospheric pressure. No expensive pressurized equipment is needed.

Advantages of the present invention will become more apparent upon consideration of the following examples.

EXAMPLES

Example 1

This example shows the effectiveness of carbonic acid wash followed by sulfuric acid wash in recovering bound alkali-from a water washed coal.

A sample of 1450 mesh, Kentucky No. 11 coal, having an ash content of 10.4% and a sulfur content of 34%, was contacted with a mixture of sodium hydroxide and potassium hydroxide at 370° C. for 2 hours at atmospheric pressure. The coal was separated from the caustic by flotation, and then washed thoroughly with water at a temperature of 70° C.

Figure 2:
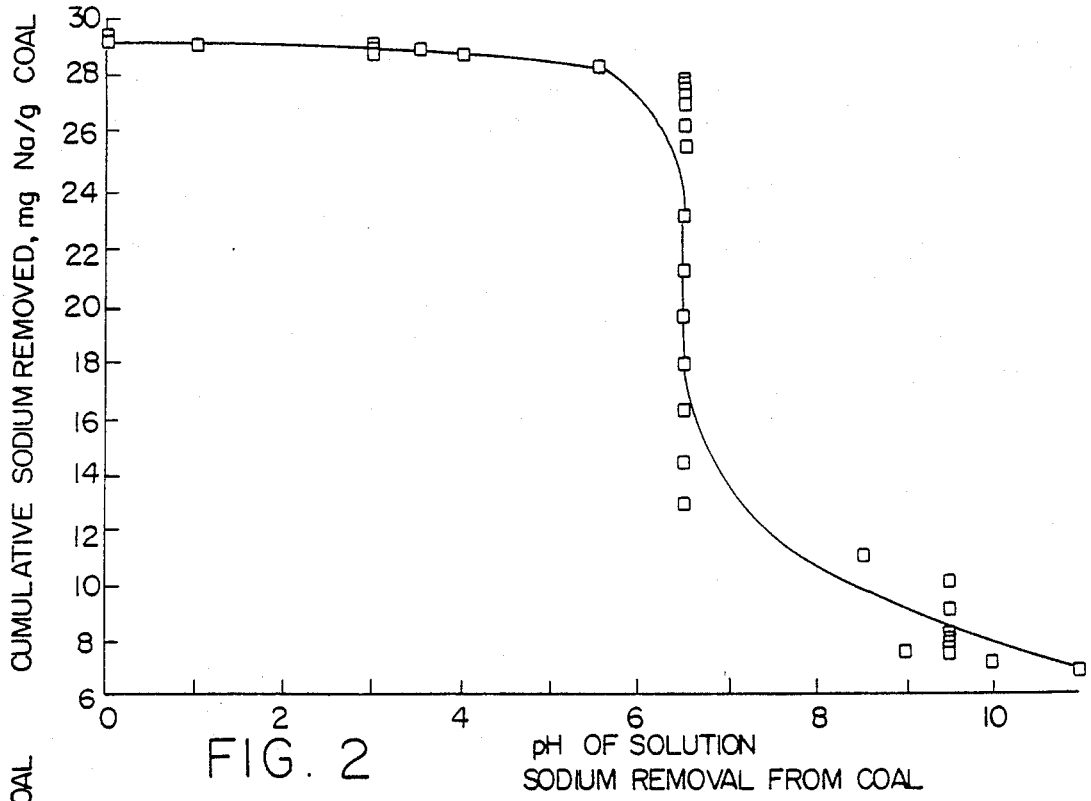
FIG. 2 shows the effect of pH on the removal of sodium from coal.
Figure 3:
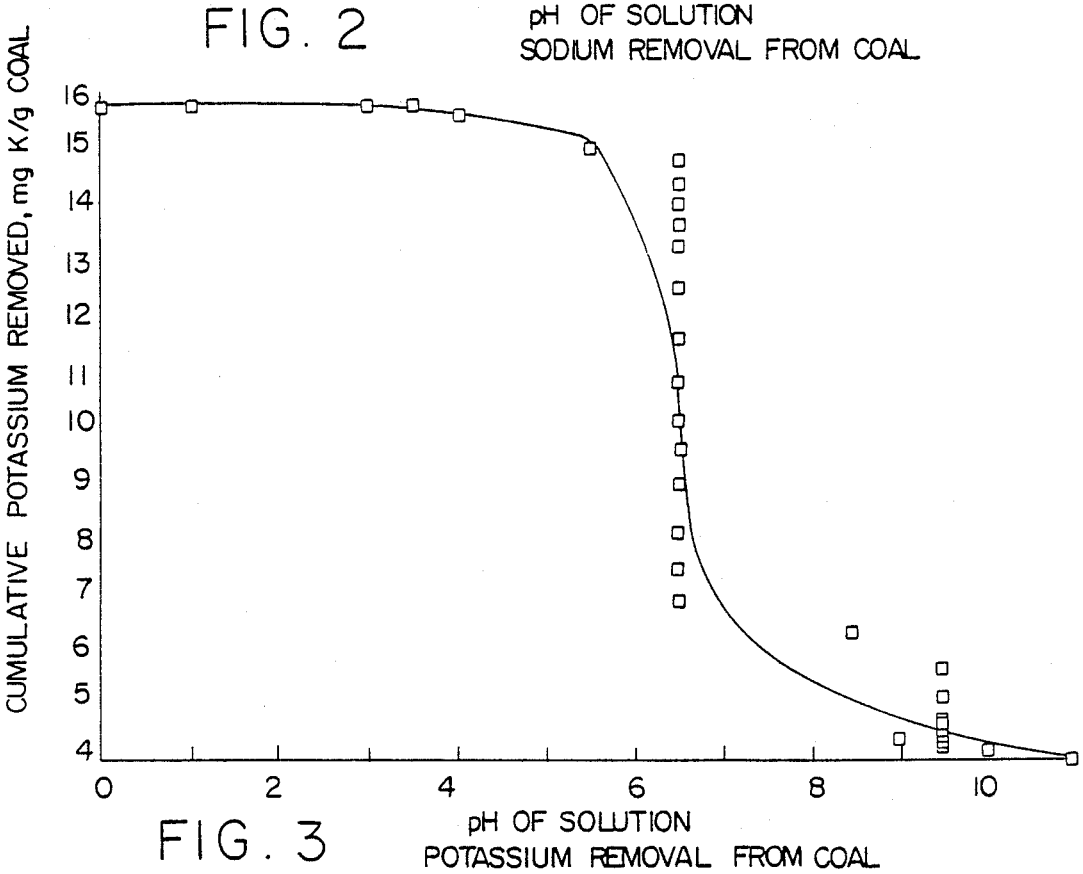
FIG. 3 shows the effect of pH on the removal of potassium from coal.

Forty grams of the water washed coal were added to 400 ml of water in a laboratory beaker. FIG. 2 and FIG. 3 show that water-washed coal equilibriated with deionized water has a pH of about 11. For the sample size tested, this resulted in the removal of 7 mg of Na plus 4 mg of K per gram of coal. That is equivalent to 1.1% Na+K, or about 1.8% by weight free NaOH+KOH, representing residual free caustic left on the water washed coal.

Carbon dioxide was bubbled into the coal-water mixture. The pH decreased until it stabilized at about 5. Sulfuric acid was added gradually to bring the pH down to about zero. The amounts of Na and K in solution were monitored as functions of pH. FIGS. 2 and 3 show the results.

The carbonic acid-sulfuric acid-washed coal was then separated and analyzed. It showed an ash content of about 0.3% and a total alkali metal content of less than about 0.1%.

As shown in FIGS. 2 and 3, the total amount of bound alkali removable by acid at a pH of zero, being the additional amounts of Na and K removed into solution by lowering the pH from about 11 to 0, was about 3.4% Na+K, being 22 mg Na and 12 mg. K per gram of coal.

At a pH of about 5, the amount of bound caustic removed was 20 mg Na and 11 mg K per gram of coal or a total of about 3.1% Na+K. That is, about 90% of the acid-removable bound caustic can be removed by using carbonic acid.

This example shows that carbonic acid can be used to recover bound alkali not removable by water wash. It also shows that carbonic acid alone does not remove all the bound alkali. A strong acid like sulfuric acid is needed to finish the job.

TABLE 1

| Run # | Coal Type and Size | Carbonic Acid Wash to Remove Ash and/or Alkali Metals: Step | Ash | % w/w Coal Na | % w/w Coal K |
|---|---|---|---|---|---|
| 1 | Pittsburgh | Water Washed | 15.72 | NA* | NA |
| | No. 8 | Water plus $CO_2$ | 8.03 | NA | NA |
| 2 | Pittsburgh | Water Washed | 10.74 | NA | NA |
| | No. 8 | Water plus $CO_2$ | 3.18 | NA | NA |
| 3 | Kentucky | Water washed | 9.98 | NA | NA |
| | No. 11 | Water plus $CO_2$ | 3.09 | NA | NA |
| 4 | Pittsburgh | Water washed | NA | 1.48 | 1.31 |
| | No. 8 | Water plus $CO_2$ | NA | 0.81 | 0.91 |
| | | Water plus grind plus $CO_2$ | NA | 0.53 | 0.82 |
| 5 | Pittsburgh | Water washed | 7.52 | 3.63 | 2.23 |
| | No. 8 | Water plus grind | 5.20 | 0.54 | 0.54 |
| | | plus $CO_2$ | NA | NA | NA |
| 6 | Illinois | Water washed | 15.87 | 3.17 | 1.78 |
| | No. 6 | Water plus $CO_2$ | 8.46 | 2.45 | NA |
| | | Water plus grind plus $CO_2$ | 7.85 | NA | 0.36 |
| 7 | Kentucky No. 11 | Water washed | NA | 14.80 | 5.40 |
| | | Water plus | NA | 0.34 | 0.31 |
| | | Carbonic acid | NA | NA | NA |

*Not available

Example 2

This example shows that carbonic acid is effective in reducing the ash content and alkali content of water-washed coal.

Three coal samples, each 14 plus 100 mesh, were subjected to fused caustic treatment and water wash steps as described above. Each of the water-washed coal samples was dried and analyzed for its ash content and/or alkali metal content.

In runs 1–6, each coal sample was then slurried in water, in a mass ratio of 400 ml water per 40 g. of coal. The coal slurry was sparged with $CO_2$ for about 60 minutes, at the end of which the pH of each slurry was from about 4.5 to about 5. The coal was separated, washed with water, dried, and analyzed for ash and/or alkali metals.

In runs 4–6, the coal was subject to post treatment in that the coal was ground in a water slurry, and again exposed to carbonic acid for another 60 minutes. Then the coal was dried and analyzed.

In run 7, instead of bubbling carbon dioxide into a coal/water slurry, water saturated with carbon dioxide was passed through the water washed coal sample contained in a column.

The results are tabulated in Table 1. The results demonstrate that a carbonic acid wash substantially reduces the ash and/or alkali metal content of coal which has been treated with fused caustic and then thoroughly water washed.

Although the present invention has been described in considerable detail with reference to certain preferred versions thereof, other versions are possible. For example, it is not necessary to recycle the caustic material. An alternative is to use a relatively small amount of alkali metal caustic to contact coal in reaction zone 10 and to send all of the reaction mixture 11 exiting reaction zone 10 to the water wash zone. Thus all of the recycled alkali metal caustic passes through an aqueous process. Therefore the spirit and scope of the appended claims should not be limited to the preferred versions contained herein.

What is claimed is:

1. A process for reducing the sulfur content and ash content of a feed coal containing sulfur and mineral matter, the processing comprising the steps of:

(a) treating the feed coal in a reaction zone with fused alkali-metal caustic at an elevated temperature to remove mineral matter and sulfur from the feed coal, yielding a caustic-treated coal containing chemically bound alkali;

(b) subsequent to step (a), washing the caustic-treated coal with water to yield water-washed coal and a caustic-rich water;

(c) subsequent to step (b), washing the water-washed coal with carbonic acid for releasing chemically bound alkali from the water-washed coal to yield carbonic acid-washed coal and an alkali metal carbonate solution; and (d) subsequent to step (c), washing the carbonic acid-washed coal with an acid stronger than the carbonic acid to yield (i) product coal having a sulfur content lower than the sulfur content of the feed coal and an ash content lower than the ash content of the feed coal, and (ii) spent acid.

2. The process of claim 1 wherein the temperature in the reaction zone is from about 280° to about 400° C.

3. The process of claim 1 wherein the caustic is selected from the group consisting of sodium hydroxide, potassium hydroxide, and mixtures thereof.

4. The process of claim 1 wherein the feed coal is treated with sufficient fused alkali-metal caustic to form a free flowing slurry of coal and caustic.

5. The process of claim 1 wherein the ratio of caustic to feed coal is from about 2 to about 20 parts by weight caustic per part of coal.

6. The process of claim 1 in which the caustic treated coal is washed with sufficient water such that the water washed coal contains less than about 5% by weight free caustic.

7. The process of claim 1 in which the water-washed coal is washed with sufficient carbonic acid such that the carbonic acid-washed coal contains substantially no free caustic and less than about 1.5% by weight bound alkali.

8. The process of claim 1 wherein the water-washed coal is washed with sufficient carbonic acid such that the combination of coal and carbonic acid has a pH of less than about 6, and the carbonic acid-washed coal contains less than about 0.5% by weight bound alkali.

9. The process of claim 1 wherein the feed coal has an ash content of greater than about 6% by weight and a sulfur content of greater than about 2% by weight, and wherein the product coal has an ash content of less than about 0.1% by weight and a sulfur content of less than about 0.5% by weight.

10. A process for reducing the sulfur content and ash content of a feed coal containing sulfur and mineral matter, the process comprising the steps of:

(a) treating the feed coal in a reaction zone to remove fused alkali metal caustic at an elevated temperature to remove mineral matter and sulfur from the feed coal, yielding a caustic-treated coal containing chemically bound alkali;

(b) subsequent to step (a), washing the caustic-treated coal with water to yield water-washed coal and a caustic-rich water;

(c) subsequent to step (b), washing the water-washed coal with carbonic acid for releasing chemically bound alkali from the water-washed coal to yield carbonic acid-washed coal and a carbonate solution comprising alkali metal carbonates and bicarbonates;

(d) subsequent to step (c), washing the carbonic acid-washed coal with an acid stronger than the carbonic acid to yield (i) product coal having a sulfur content lower than the sulfur content of the feed coal and an ash content lower than the ash content of the feed coal, and (ii) spent acid;

(e) recovering substantially anhydrous alkali metal caustic by the steps of:

(i) treating the carbonate solution with lime in a caustic regeneration zone to give a dilute aqueous caustic and a calcium carbonate precipitate;

(ii) separating the dilute aqueous caustic from the precipitate;

(iii) removing substantially all of the water from the dilute aqueous caustic to recover substantially anhydrous alkali metal caustic; and (f) recycling the recovered alkali metal caustic to the reaction zone.

11. The process of claim 10 in which the step of washing the caustic-treated coal with water comprises washing with water removed from the dilute aqueous caustic.

12. The process of claim 9 in which the step of washing the water-washed coal with carbonic acid comprises forming carbonic acid with water removed from the dilute aqueous caustic.

13. The process of claim 10 comprising the additional step of heating the precipitated calcium carbonate in a lime recovery zone to produce lime and carbon dioxide.

14. The process of claim 13 in which the step of washing the water-washed coal with carbonic acid comprises forming carbonic acid with the carbon dioxide produced in the lime recovery zone.

15. The process of claim 14 in which the step of treating the carbonate solution with lime comprises treating the carbonate solution with the lime produced in the lime recovery zone.

16. The process of claim 10 wherein the step of treating feed coal with fused alkali metal caustic yields a mixture of the caustic-treated coal and a spent fused caustic containing sulfur and mineral matter removed from the coal, the process further comprising the steps of:

(a) separating at least a portion of the spent fused caustic from the caustic-treated coal; and (b) recycling the separated spent fused caustic to the reaction zone.

17. The process of claim 16 wherein substantially all fused alkali metal caustic present in the mixture of the caustic-treated coal and spent fused coal is recycled to the reaction zone in the (a) separated spent fused caustic and (b) the recovered alkali metal caustic.

18. The process of claim 16 wherein the feed coal is treated with sufficient fused alkali metal caustic to form a free flowing slurry of coal and caustic.

19. The process of claim 16 wherein the ratio of caustic to feed coal in the reaction zone is from about 2 to about 20 parts by weight caustic per part of coal.

20. The process of claim 16 wherein the recycled spent fused caustic has a sulfur content of less than about 2% by weight sulfur and less than about 5% by weight mineral matter.

21. A process for reducing the sulfur content and ash content of a feed coal containing sulfur and mineral matter, the process comprising the steps of:

(a) treating the feed coal in a reaction zone with fused alkali metal caustic at an elevated temperature to remove mineral matter and sulfur from the feed coal, yielding a caustic-treated coal containing chemically bound alkali;

(b) subsequent to step (a), washing the caustic-treated coal with water to yield water washed coal and a caustic-rich water containing sulfur compounds and mineral matter;

(c) subsequent to step (b), washing the water-washed coal with carbonic acid for releasing chemically bound alkali from the water-washed coal to yield carbonic acid-washed coal and a first carbonate solution comprising alkali metal carbonates and bicarbonates;

(d) subsequent to step (c), washing the carbonic acid-washed coal with an acid stronger than the carbonic acid to yield (i) product coal having a sulfur content lower than the sulfur content of the feed coal and an ash content lower than the ash content of the feed coal, and (ii) spent acid;

(e) recovering substantially anhydrous alkali metal caustic by the steps of:

(i) cooling the caustic-rich water to yield (A) a first precipitate comprising alkali metal sulfides and mineral matter, and (B) concentrated aqueous caustic; and (ii) removing the water from the concentrated aqueous caustic to recover substantially anhydrous alkali metal caustic; and (f) recycling the recovered alkali metal caustic to the reaction zone.

22. The process of claim 21 further comprising the recovery of addition alkali metal caustic by the steps of:

(a) treating the first carbonate solution with lime in a caustic regeneration zone to give a first dilute aqueous caustic, and a second precipitate- comprising calcium carbonate;

(b) separating the first dilute aqueous caustic from the second precipitate;

(c) removing the water from the first dilute aqueous caustic to recover additional substantially anhydrous alkali metal caustic; and (d) recycling the additional alkali metal caustic recovered from the first dilute aqueous caustic to the reaction zone.

23. The process of claim 22 further comprising the recovery of additional alkali metal caustic by the steps of:

(a) contacting the first precipitate with water to give (i) an alkali metal sulfide solution, and (ii) solid mineral matter;

(b) treating the alkali metal sulfide solution with carbon dioxide to give hydrogen sulfide gas and a second carbonate solution comprising alkali metal carbonates and bicarbonates;

(c) treating the second carbonate solution with lime in caustic regeneration zone to give a second dilute aqueous caustic, and a third precipitate comprising calcium carbonate;

(d) separating the second dilute caustic from the third precipitate;

(e) removing the water from the second dilute aqueous caustic to yield additional substantially anhydrous alkali metal caustic; and (f) recycling the additional alkali metal caustic recovered from the second dilute caustic to the reaction zone.

24. The process of claim 23 wherein lime is regenerated for reuse by heating the precipitated calcium carbonate in a lime recovery zone to produce lime and carbon dioxide.

25. The process of claim 23 wherein at least part of the carbon dioxide produced in the lime recovery zone is used for treating the alkali metal sulfide solution.

26. The process of claim 23 wherein the hydrogen sulfide gas is used to form sulfuric acid which is used for washing the carbonic acid-washed coal.

27. The process of claim 26 wherein the spent acid is neutralized with lime to give waste water containing dissolved alkali metal sulfates and insoluble calcium sulfate.

28. A process for upgrading a feed coal, which has been physically cleaned and which has a mineral matter content of greater than about 6% by weight and a sulfur content of greater than about 2% by weight, to produce a product coal with an ash content of less than 0.1% by weight of a sulfur content of less than about 0.5% by weight, the process comprising the steps of:

(a) contacting feed coal in a reaction zone with fused alkali metal caustic at a temperature of from about 325° to 375° C. and substantially atmospheric pressure to remove sulfur and mineral matter from the feed coal, yielding caustic-treated coal containing chemically bound alkali, the caustic being selected from the group consisting of sodium hydroxide, potassium hydroxide, and mixtures thereof, the mass ratio of fused alkali metal caustic to coal being from about 2:1 to about 20:1;

(b) subsequent to step (a), washing the caustic-treated coal with sufficient water to yield:

(i) a water-washed coal containing less than about 5% by weight free caustic, and (ii) a caustic-rich water containing sulfur and mineral matter and having an alkali metal hydroxide concentration of from about 40 to about 50% by weight;

(c) subsequent to step (b), contacting the water-washed coal with sufficient carbonic acid to from a coal/carbonic acid mixture with a pH of less than about 6 for releasing chemically bound alkali from the water-washed coal, then separating the mixture to give:

(i) a carbonic acid-washed coal containing substantially no free caustic and less than about 0.5% by weight bound alkali and (ii) a first carbonate solution containing alkali metal carbonates and bicarbonates;

(d) subsequent to step (c), washing the carbonic acid-washed coal with sulfuric acid having a pH of less than about 2 to give product coal and spent sulfuric acid;

(e) recovering anhydrous alkali metal caustic for recycle to the reaction zone by the steps of:

(i) cooling the caustic-rich water to yield (A) a first precipitate comprising alkali metal sulfides and mineral matter and (B) a concentrated aqueous caustic, (ii) contacting the first precipitate with water to give an alkali metal sulfide solution and solid mineral matter, (iii) treating the alkali metal sulfide solution with carbon dioxide in a sulfide reaction zone to give hydrogen sulfide and a second carbonate solution comprising alkali metal carbonates and bicarbonates, (iv) treating the first and the second carbonate solutions with lime in a caustic regeneration zone to give a dilute aqueous caustic and a second precipitate comprising calcium carbonate, (v) removing the water from the concentrated and dilute aqueous caustics to recover anhydrous alkali metal caustic, (vi) recycling the recovered anhydrous alkali metal caustic to the reaction zone;

(f) regenerating the lime by heating the second precipitates in a lime recovery zone to produce lime and carbon dioxide;

(g) forming the carbonic acid for washing the water washed coal and to treat the alkali metal sulfide solution with carbon dioxide produced in the lime recovery zone;

(h) producing the sulfuric acid used to wash the carbonic acid-washed coal with hydrogen sulfide produced in the sulfide reaction zone; and (i) neutralizing the spent sulfuric acid with lime to give waste water containing alkali metal sulfates and insoluble calcium sulfate.

29. The process of claim 28, wherein the step of contacting feed coal with fused alkali metal caustic yields a mixture of the caustic-treated coal and a spent fused caustic containing sulfur and mineral matter removed from the coal, the process further comprising the steps of:

(a) separating at least a portion of the spent fused caustic from the caustic-treated coal; and (b) recycling the separated spent fused caustic to the reaction zone;

wherein the recycled spent fused caustic comprises less than about 2% by weight sulfur and less than about 5% by weight mineral matter.

30. The process of claim 29 wherein substantially all of the caustic in the mixture of the caustic-treated coal and spent fused caustic is recycled to the reaction zone in (a) separated spent fused caustic and (b) recovered anhydrous alkali metal caustic.

31. The process of claim 1, 10, 21, or 28 wherein the step of washing the caustic-treated coal with water comprises washing the coal in a countercurrent staged system comprising a plurality of stages, including at least one intermediate stage wherein each intermediate stage comprises the steps of:

(i) slurrying the coal with water, (ii) separating the slurry into wet coal and a liquid, and (iii) sending the wet coal to the following stage and the liquid to the prior stage.

32. A process for reducing the sulfur content and ash content of a feed coal containing sulfur and mineral matter, the process comprising the steps of:

(a) treating feed coal in a reaction zone with fused alkali-metal caustic at an elevated temperature to remove mineral matter and sulfur from the feed coal, yielding a caustic-treated coal containing chemically bound alkali;

(b) subsequent to step (a), washing the caustic-treated coal with water to yield water-washed coal and a caustic-rich water in a countercurrent staged water-washed system containing a plurality of stages, including at least one intermediate stage wherein each intermediate stage comprises the steps of:

(i) slurrying the coal with water, (ii) separating the slurry into wet coal and a liquid, and (iii) send the wet coal to the following stage and the liquid to the prior stage; and (c) subsequent to step (b), washing the water-washed coal with an acid to yield (i) product coal having a sulfur content lower than the sulfur content of the feed coal and an ash content lower than the ash content of the feed coal, and (ii) spent acid.

* * * * *